US009289911B2

(12) United States Patent
Andreato et al.

(10) Patent No.: US 9,289,911 B2
(45) Date of Patent: Mar. 22, 2016

(54) STATIONARY BLADE ASSEMBLY

(75) Inventors: Cristian Andreato, Parma (IT); James Carmichael, Parma (IT)

(73) Assignee: SIDEL S.p.A. con Socio Unico (IT)

( * ) Notice: Subject to any disclaimer, the term of this patent is extended or adjusted under 35 U.S.C. 154(b) by 289 days.

(21) Appl. No.: 13/984,683

(22) PCT Filed: Feb. 10, 2012

(86) PCT No.: PCT/EP2012/052358

§ 371 (c)(1),
(2), (4) Date: Oct. 16, 2013

(87) PCT Pub. No.: WO2012/107583

PCT Pub. Date: Aug. 16, 2012

(65) Prior Publication Data

US 2014/0041499 A1 Feb. 13, 2014

(30) Foreign Application Priority Data

Feb. 11, 2011 (IT) ..... TO20110008 U

(51) Int. Cl.
*B26D 1/38* (2006.01)
*B26D 1/00* (2006.01)
(Continued)

(52) U.S. Cl.
CPC ..... *B26D 1/385* (2013.01); *B26D 1/0006* (2013.01); *B26D 1/405* (2013.01); *B26D 7/2614* (2013.01); *B65C 9/1803* (2013.01); *B65C 9/1819* (2013.01); *E05D 5/023* (2013.01); *B26D 2001/0053* (2013.01); *B65C 2009/1861* (2013.01); *B65H 2301/46152* (2013.01); *E05Y 2600/51* (2013.01); *E05Y 2600/632* (2013.01); *E05Y 2900/132* (2013.01);
(Continued)

(58) Field of Classification Search
CPC .. Y10T 83/4795; Y10T 83/4847; B26D 1/02; B26D 1/025385; B26D 1/38; B26D 1/405; B26D 1/0006; B26B 21/54–21/60; B26B 9/00; B26B 9/02
USPC ..... 83/331, 349; 30/346–357
See application file for complete search history.

(56) References Cited

U.S. PATENT DOCUMENTS 3,791,429 A * 2/1974 Morris ..... 144/218
3,822,625 A 7/1974 Obenshain
(Continued)

FOREIGN PATENT DOCUMENTS

EP 0078076 A2 5/1983
WO WO-97/10953 A1 3/1997
WO WO-2012/107583 A1 8/2012

OTHER PUBLICATIONS

"International Application Serial No. PCT/EP2012/052358, International Search Report mailed Jun. 12, 2012", 4 pgs.
(Continued)

*Primary Examiner* — Ned Landrum
*Assistant Examiner* — Richard Crosby, Jr.
(74) *Attorney, Agent, or Firm* — Schwegman Lundberg & Woessner, P.A.

(57) ABSTRACT

A stationary blade assembly for cutting labels from a label film in labelling machines, including: a support, a blade supported by said support; blade, a pair of first surfaces interposed between a second surface and a corresponding third surface transversal to the second surface. The stationary blade includes at least two cutting edges which are adapted to cut said labels.

10 Claims, 3 Drawing Sheets

(51) Int. Cl.

| | |
|---|---|
| ***B26D 1/40*** | (2006.01) |
| ***B65C 9/18*** | (2006.01) |
| ***E05D 5/02*** | (2006.01) |
| ***B26D 7/26*** | (2006.01) |

(52) U.S. Cl.
CPC ..... *E05Y 2900/148* (2013.01); *Y10T 83/4847* (2015.04); *Y10T 83/9457* (2015.04); *Y10T 83/9493* (2015.04); *Y10T 83/9498* (2015.04)

(56) References Cited

U.S. PATENT DOCUMENTS

| | | | | | |
|---|---|---|---|---|---|
| 3,827,119 | A * | 8/1974 | Bennett | ..... | 407/40 |
| 3,899,947 | A * | 8/1975 | Faltin | ..... | B26D 1/565 144/218 |
| 5,439,039 | A * | 8/1995 | Bradstreet et al. | ..... | 407/40 |
| 5,558,142 | A * | 9/1996 | Ehrle et al. | ..... | 144/230 |
| 5,755,654 | A * | 5/1998 | Schulz | ..... | B26D 1/0006 493/350 |
| 6,481,318 | B1 | 11/2002 | Kinigakis et al. | | |
| 7,909,546 | B2 * | 3/2011 | Nada et al. | ..... | 407/114 |
| 2005/0109179 | A1 * | 5/2005 | Behringer | ..... | 83/331 |
| 2006/0266179 | A1 | 11/2006 | Yamashita | | |
| 2012/0216663 | A1 * | 8/2012 | Carmichael | ..... | 83/349 |

OTHER PUBLICATIONS

"International Application Serial No. PCT/EP2012/052358, Written Opinion mailed Jun. 12, 2012", 5 pgs.

* cited by examiner

STATIONARY BLADE ASSEMBLY

RELATED APPLICATIONS

This application is a U.S. National Stage Filing under 35 U.S.C. 371 from International Application No. PCT/EP2012/052358, filed on Feb. 10, 2012, and published as WO 2012/107583 A1 on Aug. 16, 2012, which claims the benefit under 35 U.S.C. 119 to Italian Application No. TO2011U000008, filed on Feb. 11, 2011; which applications and publication are incorporated herein by reference in their entirety.

TECHNICAL FIELD

The present innovation relates to a stationary blade assembly.

BACKGROUND ART

Labelling machines are known, especially of the kind that use a label reel from which labels are cut and applied onto articles, in particular articles filled with a pourable food product.

The above-identified machines, known as roll fed labelling machines, substantially comprise a carousel for advancing the articles along a path, and a labelling unit which applies a plurality of labels onto relative articles along the path.

In detail, the labelling unit comprises:

- at least one motorized feeding roll for moving a strip of label from a label reel towards the carousel;
- a cutting unit for cutting a label of a given length from the label strip; and
- a vacuum suction drum which receives the cut labels and transfers the labels to the articles in the carousel.

Cutting unit comprises a rotary blade assembly and a stationary blade assembly which are positioned adjacent to the vacuum suction drum.

More precisely, rotary blade comprises a rotating drum and one or more cutting edges arranged at an outer periphery of the rotating drum.

Stationary blade assembly comprises a support and a blade which projects outwards from the support.

The label strip is taken at its free end by suction by the vacuum drum, and passes between the stationary and the rotary blade of the cutting unit.

More precisely, since the vacuum drum rotates an higher speed than the label strip speed, the vacuum drum pulls an end of the label strip.

The label strip thus passes within a passage which is defined by the rotary and stationary blades. When the rotary and stationary blades face each other, a label is cut and separated by the vacuum drum from the remaining part of the label strip.

Stationary blade is generally pentagonal or triangular in section and comprises only one cutting edge.

Furthermore, stationary blade is generally made in a softer material than the rotary blade.

The rotary blades are commonly square with multiple useable edges.

Furthermore, the rotary blades are commonly made of a harder material such as carbide to resist wearing from the label sliding across the cutting edge.

Accordingly, the stationary blade needs to be changed more often than the rotary blade.

A need is felt within the industry to reduce the time and the costs connected with the stationary blade replacement, so as to increase the throughput of the labelling machine.

DISCLOSURE OF INVENTION

It is an object of the present innovation to provide a stationary blade assembly, designed to meet the above-identified requirement.

According to the present innovation, there is provided a stationary blade assembly, as claimed in claim 1.

SUMMARY

Examples of the present subject matter provide a stationary blade assembly, designed to meet the above-identified requirement.

According to the present subject matter, there is provided a stationary blade assembly, as claimed in claim 1.

BRIEF DESCRIPTION OF THE DRAWINGS

A non-limiting embodiment of the present subject matter will be described by way of example with reference to the accompanying drawings, in which.

DETAILED DESCRIPTION

Figure 1:
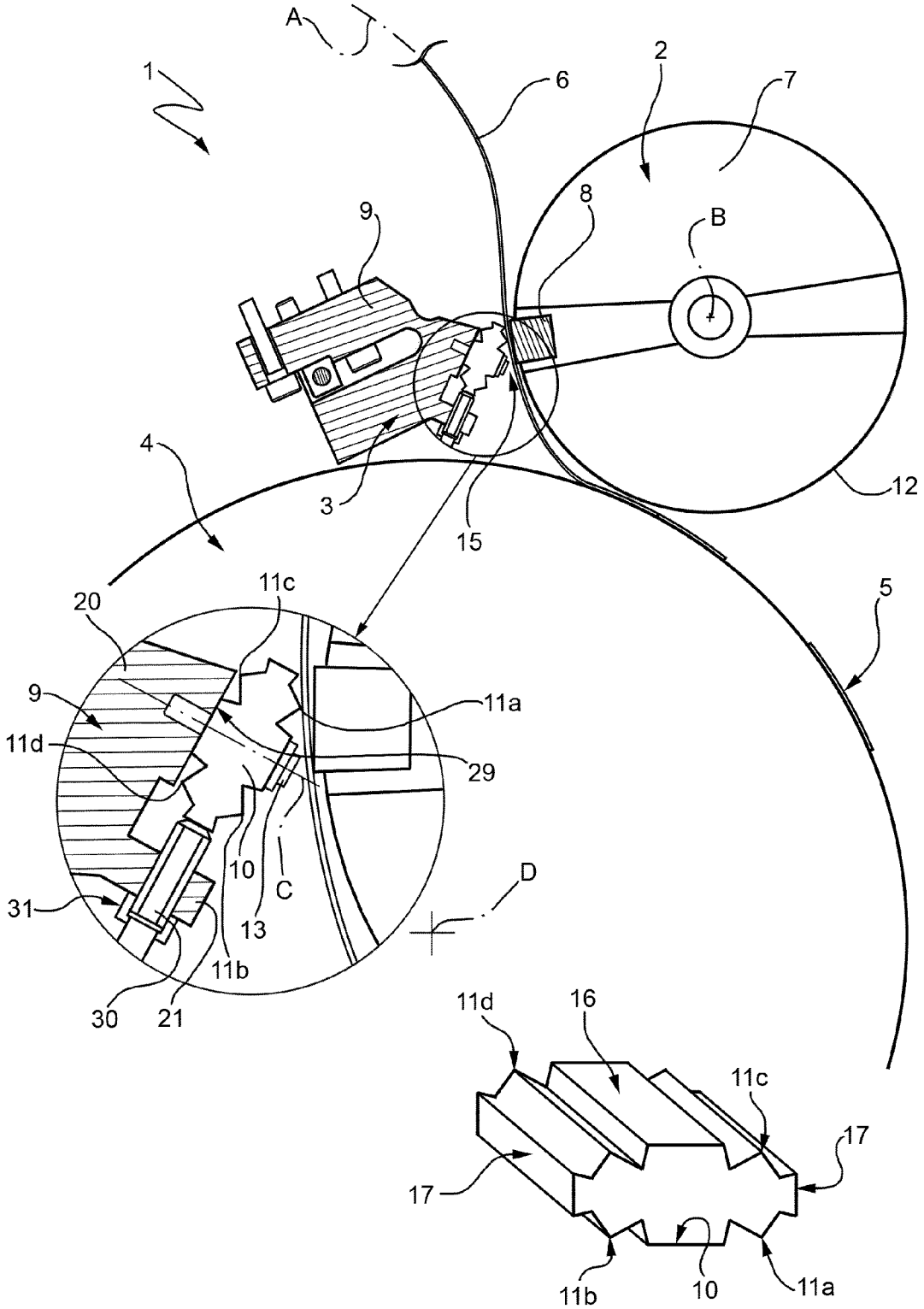
FIG. 1 shows a schematic top view of a cutting unit which comprises a stationary blade assembly according to a first embodiment.

Number 1 in FIG. 1 indicates as a whole a cutting unit for cutting a label 5 from a labels strip 6.

Cutting unit 1 is adapted to be incorporated into a labeling machine, especially into a roll-fed labeling machine for applying labels 5 to relative articles, in particular containers filled with pourable product.

In detail, the roll-fed labeling machine (not shown) substantially comprises:

- a label reel from which label strip 6 is unwound along a path A from a motorized roll;
- a carrousel for advancing articles along an additional curved path; and
- a labeling unit for applying labels 5 onto relative articles which are advanced by carousel.

Labeling machine also comprises at least one feeding roll for moving labels strip 6 from reel towards carousel.

Cutting unit 1 cuts label 5 from strip 6 and conveys them towards carousel.

Cutting unit 1 substantially comprises:

- a drum 2 which rotates about an axis B;
- a stationary blade assembly 3 adapted to interact with drum 2 to separate a label 5 from label strip 6; and
- a vacuum-suction drum 4 adapted to advance each cut label 5 which has been separated from the remaining part of the label strip 6.

In detail, drum 2 comprises a cylindrical main body 7 and a blade 8 which outwardly protrudes from an outer periphery 12 of body 7. Blade 8 is provided with a cutting edge 39.

Drum 2 could also comprise a plurality of blades 8.

Assembly 3 comprises a support 9, and a blade 10 which protrudes outwardly from support 9.

Blade 10 and outer periphery 12 of body 7 define a passage 15 for the label strip 6.

At a given angular position of drum 2 shown in FIG. 1, the operational edges of blade 8 and blade 10 face each other at close proximity or with minimal contact with a consequent cutting action.

In such a condition, blades 8, 10 cut label 5 and separate it from label strip 6.

Vacuum suction drum 4 rotates about an axis D parallel to axis B and conveys cut label 5 towards carousel by means of vacuum applied onto such a cut label 5.

Blade 10 advantageously comprises a plurality of cutting edges 11*a*, 11*b*, 11*c*, 11*d*, four in the embodiment shown.

In particular, blade 10 comprises (FIG. 2):

- a pair of rectangular clamping surfaces 16 opposite to and parallel each other; and
- a pair of rectangular locating surfaces 17 opposite to and parallel each other.

Blade 10 also comprises, proceeding from one surface 17 to one of the surfaces 17 adjacent thereto:

- a surface 60 transversal to surface 16;
- a surface 50 orthogonal to surface 60;
- a surface 51 orthogonal to surface 50; and
- a surface 61 orthogonal to surface 51.

Surfaces 61, 50; 50, 51; and 51, 60 are orthogonal to each other.

Surfaces 61, 50, 51, 60 are finished by using a grinding wheel.

Each pair of surfaces 50, 51 adjacent to each other are sharply joined so as to form a relative cutting edge 11*a*, 11*b*, 11*c*, 11*d*.

Surfaces 61, 51; 50, 60 adjacent to each other are sharply joined to each other.

Surfaces 60 originate from a relative surface 16 and diverge from each other, starting from the relative surface 16.

Surfaces 61 originate from a relative surface 17 and converge towards each other, starting from the relative surface 17.

Surfaces 16 have a symmetry axis C.

Surfaces 17 have a symmetry axis Y orthogonal to axis C.

Cutting edges 11*a*, 11*b*, 11*c*, 11*d* are slightly inclined relative to an axis X, which is orthogonal to axes C, Y.

Cutting edges 11*a*, 11*b*, 11*c*, 11*d* are also inclined relative to cutting edge 39 of blade 8.

Blade assembly 3 comprises a plurality of releasable connecting elements 13 for connecting surfaces 16 to support 9 (FIG. 1).

Connecting elements 13 consist, in the embodiment shown, of five to nine screws.

In particular, surfaces 16 defines a plurality of holes 14 engaged by relative connecting elements 13.

Connecting elements 13 have shanks which pass through respective holes 14 with play.

Holes 14 have their own axes which are parallel to axis C.

Support element 9 comprises a main body 20 and an appendix 21 which protrudes from body 20 (FIG. 1).

Body 20 is bounded by a wall 29 which cooperates with one surface 16 of blade 10 and onto which connecting elements 13 are screwed.

Appendix 21 protrudes from wall 29 on the opposite side of body 20.

Blade assembly 3 also comprises regulating means to stabilize the final position of blade 10 after contact adjustment Regulating means comprise, in the embodiment shown:

- a jacking screw 30 which pass through appendix 21 and cooperates with one of surfaces 17 of blade 10; and
- a locking nut 31 coupled with screw 30.

The operation of blade assembly 3 is described starting from a configuration, in which cutting edge 11*c* is in the cutting area.

Label strip 6 is unwound from label reel and advanced along a path A by the motorized roll.

Label strip 6 is taken up at its end by suction by vacuum suction drum 4, and advanced within passage 15 which is defined, on its opposite sides, by cutting edge 11*c* and outer periphery 12.

Due to the rotation of drum 2 about axis B, at a certain time, blade 8 faces cutting edge 11*c* of blade 10 of assembly 3 and closes passage 15 with such blade 8.

In such a position shown in FIG. 1, one label 5 is cut from the remaining part of label strip 6 by the actions of cutting edges 11*c*, 39 of blades 8 and of blade 10.

Due to the fact that cutting edges 11*c*, 39 are slanted relative to each other, the cutting action is progressive.

Cut label 5 is then conveyed by the suction action of vacuum suction drum 4 towards the carrousel where it is applied onto a relative article by the labelling group.

After that edge 11*c* has cut a given number of labels 5, edge 11*c* becomes worn out or blunted. At this stage, connecting elements 13 are released from support 9, blade 10 is rotated so as to use edge 11*a* to cut labels 5.

Figure 2:
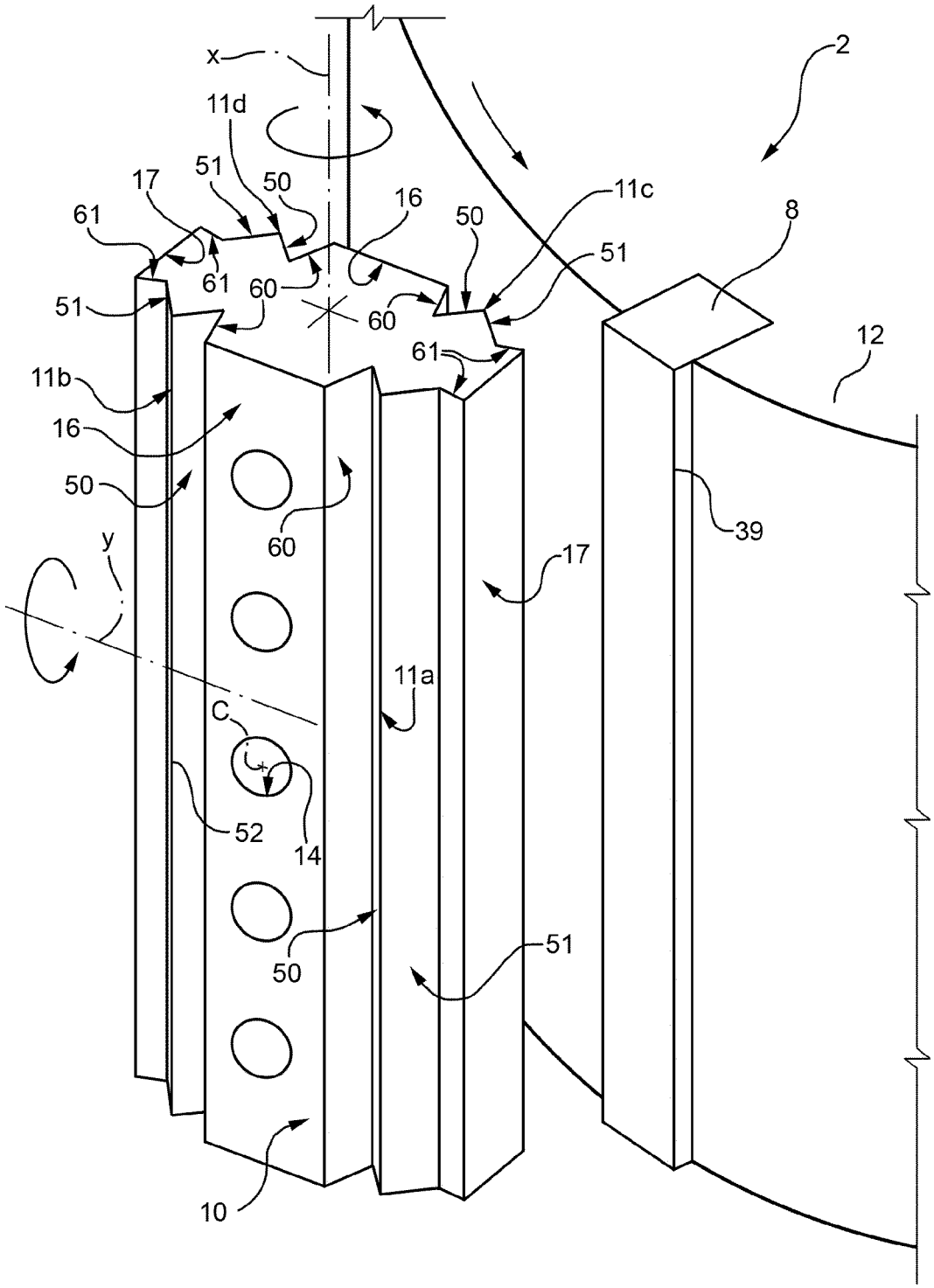
FIG. 2 is an enlarged view of some components of the cutting unit of FIG. 1.

With reference to FIG. 2, blade 10 is rotated about axis X of 180 degrees, so as to arrange edge 11*b* in front of drum 2 in the cutting area.

At this stage, blade 10 is connected again to support 9, by using the connecting elements 13.

Once that also edge 11*b* is worn out or blunted, blade 10 is disconnected by support 9, rotated about axis Y of 180 degrees, so as to arrange cutting edge 11*d* in front of drum 2 in the cutting area.

At this stage, blade 10 is connected again to support element 9 by using connecting elements 13.

Finally, once that also edge 11*d* is worn out or blunted, blade 10 is rotated about axis X of 180 degrees, so as to arrange edge 11*a* in front of drum 2 in the cutting area.

Figure 3:
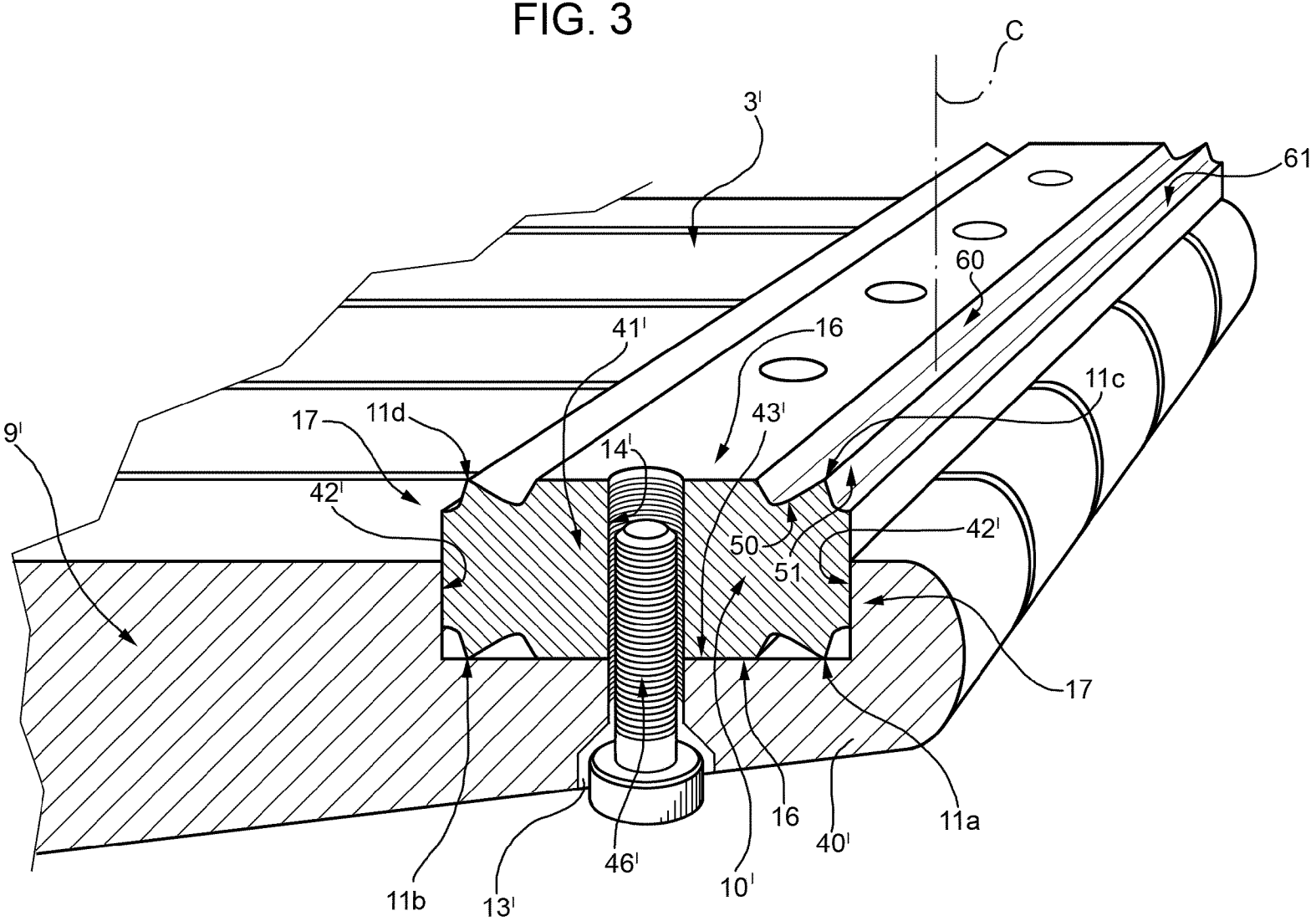
FIG. 3 shows, in an enlarged view, a section of stationary blade assembly according to a second embodiment.

Number 3' in FIG. 3 indicates a second embodiment of a blade assembly in accordance with the present subject matter; blade assembly 3. 3' being similar to each other, the following description is limited to the differences between them, and using the same references, where possible, for identical or corresponding parts.

Blade assembly 3' differs from blade assembly 3 in that support element 9' comprises multiple rounded end arm 40'.

Arm 40' has, at an its end close to the vacuum suction drum 4 and drum 2, a seat 41' engaging blade 8.

Seat 41' comprises a pair of flat walls 42' facing to each other and lying on a plane parallel to axis C, and by a wall 43' lying on a plane orthogonal to axis C.

Wall 43' cooperates with surface 16 of blade 10' and walls 42' cooperate respectively with surfaces 17 of blade 10'.

Connecting elements 13' are partly housed within holes 14' of blade 10 and partly housed within relative holes 46' defined by end arm 40'.

The length of wall 43' orthogonally to axis C is higher than the length of walls 42' parallel to axis C.

The operation of blade assembly 3' is similar to the operation of blade assembly 3 and is not described in detail.

From an analysis of the features of stationary blade assembly 3, 3' according to the present subject matter, the advantages it achieves to obtain are apparent.

In particular, blade assembly 3, 3' comprises a blade 10, 10' with more than one cutting edge 11*a*, 11*b*, 11*c*, 11*d*.

The cutting edge which is effective in cutting labels 5 may be easily changed by simply rotating blade 10, 10' of 180 degrees about axis X or axis Y.

As a result, the life of blade 10, 10' is extended when compared with the solution described in the introductory part of the present description.

Furthermore, the time losses and the costs connected with the replacement of blade 10 are reduced, so as to increase the throughput of the labelling machine.

In addition, due to the fact that edges 11*c*, 39 are slanted relative to each other, the cutting action is progressive.

Finally, it is apparent that modifications and variants not departing from the scope of protection of the claims may be made to stationary blade assembly 3, 3'.

The invention claimed is:

1. A stationary blade assembly for cutting labels from a label film in labelling machines, comprising:

a support;

a stationary blade supported by said support;

at least one pair of first surfaces;

a pair of second surfaces opposite to each other; and a pair of third surfaces opposite to each other and transversal to said second surfaces;

said at least one pair of first surfaces being interposed between a corresponding second surface and a corresponding third surface;

wherein said stationary blade comprises at least two cutting edges which are adapted to cut said labels, wherein each said cutting edge comprises:

a fourth surface originating from said third surface; and a fifth surface originating from said second surface;

said first surfaces being interposed between and orthogonal to said fourth and fifth surfaces.

2. The blade assembly of claim 1, wherein the at least one pair of first surfaces are sharply joined so as to form one of said at least two cutting edge.

3. The blade assembly of claim 2, wherein said at least one pair of said first surfaces are orthogonal to each other.

4. The blade assembly of claim 1, wherein said first, fourth and fifth surfaces are finished by using a grinding wheel.

5. The blade assembly of claim 1, wherein each said cutting edges are angled relative to a first axis (X) parallel to both said second surface and said third surface.

6. The blade assembly according to claim 1, comprising at least one releasable connecting element for releasably connecting said support and said stationary blade;

said connecting element passing through said second surface.

7. The blade assembly according to claim 1, comprising releasable regulating means for stabilizing the final position of said stationary blade after contact with said label to be cut;

said regulating means comprising:

a first element cooperating with at least one said second surface of said stationary blade; and a second element releasably coupled with at least one said first element.

8. The blade assembly of claim 1 wherein said support defines a seat for said stationary blade;

said seat comprising a pair of first walls opposite to each other, a second wall which is interposed between said first walls;

said first walls cooperating with relative said second surface of said stationary blade, and said second wall cooperating with said first surface of said stationary blade.

9. A cutting unit for cutting labels from said label film, comprising a rotary drum rotating, in use, about a second axis (B) and a stationary blade assembly according to claim 1;

said rotary drum comprising a rotary blade;

said stationary blade and said rotary blade contacting, in use, on opposite sides said label film, so as to separating a label from said label film.

10. A cutting unit according to claim 9, wherein said rotary blade comprises a rotary cutting edge; each said cutting edge cooperating with and being angled relative to said rotary cutting edge.

* * * * *